United States Patent [19]

Patkos

[11] Patent Number: 4,478,360

[45] Date of Patent: Oct. 23, 1984

[54] PRESS FEEDER

[76] Inventor: Stephen Patkos, R.R. #1, Campbellville, Ontario, Canada, L0P 1B0

[21] Appl. No.: 409,691

[22] Filed: Aug. 19, 1982

[51] Int. Cl.[3] ..... B65H 17/36

[52] U.S. Cl. ..... 225/163; 198/750

[58] Field of Search ..... 226/91, 158, 159, 160, 226/162, 163, 8, 112, 150; 198/750; 156/405 L, 406, 412

[56] References Cited

U.S. PATENT DOCUMENTS

| | | | |
|---|---|---|---|
| 2,126,453 | 8/1938 | Criley et al. | 226/112 |
| 2,389,556 | 11/1945 | Siegerist | 226/112 |
| 2,586,536 | 2/1952 | Haller | 226/162 |
| 2,990,091 | 6/1961 | Goldsworthy et al. | 226/112 |
| 3,038,646 | 6/1962 | Grimm | 226/158 |
| 3,300,242 | 1/1967 | Renfroe | 294/101 |
| 3,438,557 | 4/1969 | Lehmann | 226/8 |
| 3,583,268 | 6/1971 | Scribner | 83/225 |
| 3,735,907 | 5/1973 | Kuchar et al. | 226/150 |
| 3,844,152 | 10/1974 | Peytavin | 226/112 X |
| 3,937,379 | 2/1976 | Narwid et al. | 226/150 |
| 3,986,746 | 10/1976 | Chartier | 294/116 |
| 4,022,367 | 5/1977 | Sporenberg et al. | 226/91 |
| 4,095,733 | 6/1978 | Scribner | 226/162 |
| 4,127,999 | 12/1978 | Lorenz | 72/290 |

FOREIGN PATENT DOCUMENTS 2149067 4/1973 Fed. Rep. of Germany .

*Primary Examiner*—Leonard D. Christian

*Attorney, Agent, or Firm*—Hirons, Rogers & Scott

[57] ABSTRACT

A feeder for strip material has two carriage assemblies that reciprocate to move material intermittently through the feeder. The carriage assemblies are mounted on base plates that are adjustable relative to the center line of the feeder to accommodate different material widths. Each carriage assembly includes a clamp to grip the material. The clamp is moved between open and closed positions by an actuator that is orientated to transfer force directly between the clamping arms without transmitting clamping forces to the motor used to displace the actuator.

26 Claims, 11 Drawing Figures

PRESS FEEDER

The present invention relates to machines for feeding material such as strip material from a roll.

Strip material is frequently supplied in large rolls which must be unwound and fed into the machine that cuts or shapes it into the required form. This operation is frequently necessary on a sheet metal press where the sheet metal is supplied in roll form and is fed into a press for the initial forming operations. It is obviously necessary to feed the material into a machine such as a press intermitently to provide time for the machine to perform its operation.

The feeding of material is closely related to the operation of the press and the efficiency of the press operation can be affected by the speed of operation of the feeder. It has therefore been proposed to provide a feeder with two separate feeding mechanisms, one of which operates on the material to be fed into the press whilst the other recovers to a position where it is ready to feed material. In this way the cycle time of the press becomes a limiting factor and therefore full efficiency of the press is achieved.

The common form of feeding mechanism is a carriage that reciprocates in the direction of material feed and alternatively grips and releases the material being fed through it. The gripping is achieved by a clamp that is sequenced to grip the material prior to the feed cycle and release the material at the end of the feed stroke. Where more than one mechanism has been used, it has been proposed to place carriages on opposite sides of the axis of the feed material so that the clamps grip opposite edges of the material.

A problem found with existing feeders is the limited versatility of the feeder to meet differing stock materials. The feeders are manufactured for a specific purpose or to feed a specific material and should it be necessary to change the type of material being fed then a new feeder is required. This is obviously very expensive and time consuming and it is therefore one object of the present invention to provide a feeder which obviates or mitigates the above disadvantages.

According therefore to the present invention there is provided a feeder for feeding strip material along an axis, said feeder comprising a frame, a pair of carriage assemblies disposed on opposite sides of said axis and each including a carriage to reciprocate parallel to said axis to move material therealong, mounting means to mount said carriage assemblies on said frame and including guide means to permit sliding movement of at least one of said carriages relative to said frame in a direction transverse to said axis and adjustment means to adjust the disposition of said one carriage assembly relative to said axis whereby the spacing between said carriages may be varied to accommodate different widths of material.

A further problem associated with prior feeders is that the forces produced by clamping of the material is reacted by the motor that produces the clamping force. Such motors are typically air motors of limited stroke and it is found that the forces are reacted between the piston rod and the cylinder of the motor. The conventional bearings used in such motors are not intended to take the magnitude of the forces to which they are subjected and accordingly fail frequently. Moreover, prior to failure, the rapid wear of the bearings supporting the piston rod in the motor leads to play in the clamping mechanism and may result in unsatisfactory clamping and inaccuracy of the feeding.

According therefore to a second aspect of the invention there is provided a clamp for use with a feeder having a carriage mounted for reciprocal movement along an axis to move material along the axis, said clamp comprising a pair of clamp members each having a jaw mounted thereon and being moveable relative to one another to move said jaws into gripping engagement with said material, an actuator acting between said clamping members to transmit forces directly therebetween and motor means operable on said actuator to cause displacement of said actuator and induce relative movement between said clamping members, whereby forces generated by said jaws gripping said material are transmitted between said clamping members through said actuator to minimise forces acting on said motor means.

Embodiments of the invention will now be described by way of example only with reference to the accompanying drawings in which.

Figure 5:
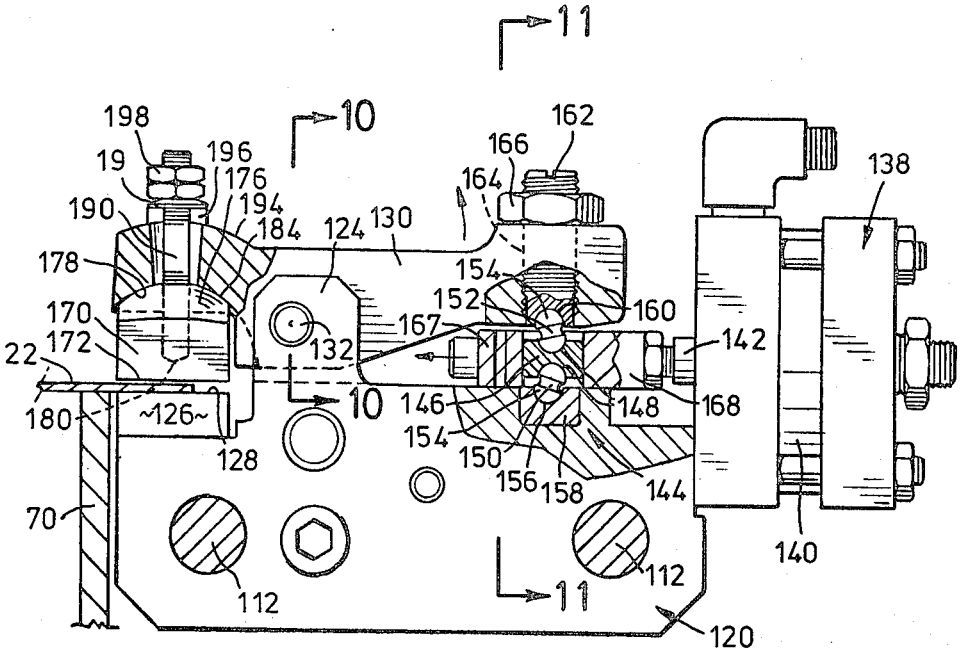
FIG. 5 is an enlarged view on the line 5—5 of FIG. 3.
Figure 8:
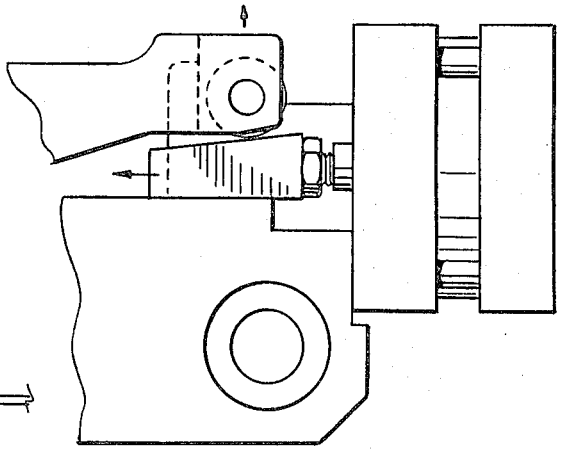

FIG. 8 an alternative arrangement of the clamping device shown in FIG. 5.

Figure 9:
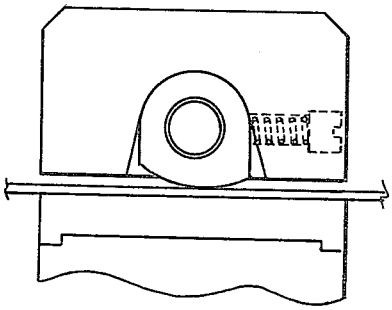

FIG. 9 is a view which shows an alternative form of clamping jaw.

Figure 10:
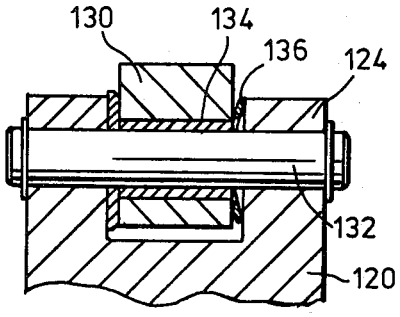

FIG. 10 is a view on the line 10—10 of FIG. 5 and

Figure 11:
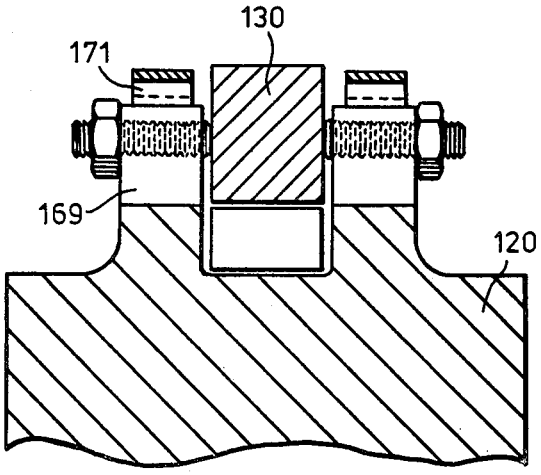

FIG. 11 is a view on the line 11—11 of FIG. 5.

A feeder 20 for strip material 22 is arranged to move the material along a generally horizontal axis 24.

The feeder 20 comprises a frame 26 made from a stand 28 and a sub-frame 30. The stand 28 includes four vertical legs 32 interconnected by stringers 34 to provide a rigid base for the feeder 20. A pair of beams 36 extend between the upper ends of legs 32 at opposite ends of the stand 28 and have a plurality of support pads 38 welded to the upper surface of the beams. Also connected to the beams 36 at spaced intervals is a plurality of plates 40 each having a transverse elongate slot 42 formed in it.

The sub-frame 30 is formed from a pair of spaced rails 44 extending transversely to the axis 24 and being interconnected by a pair of ties 46 that extend between the rails 44 at a lower level than the rails. A beam 48 extends between the two ties 46 approximately mid-way between the two rails and carries a pair of bosses 50–52. The bosses 50–52 each have a central bore 54 which is threaded to receive a lead screw 56–58 described in further detail below.

The rails 44 are formed of generally rectangular section members having an undersurface 60, an upper surface 62, a vertical outboard surface 64 and a vertical inboard surface 66. Each of the inboard surfaces 66 has a rabbet 68 formed adjacent the undersurface 60 and extending the full length of the rails 44.

A web 70 is connected to the upper surface 62 of each of the rails 44 by means of blocks 72 that are welded to the web and secured to the rail 44 by bolts 74. The web 70 is formed from a rectangular strip of material and is arranged so that its height is very much greater than its width. The web 70 is arranged on the axis 24 and is provided to support the strip material as it is moved through the feeder 20.

The undersurface 60 of rails 44 abut the pads 38 to connect the sub-frame 30 to the stand 28. Tapped holes 76 are formed in the outboard surface 64 of each of the rails and receive bolts 78 that pass through the slots 42 in the plates 40. The bolts 78 secure the sub-frame to the stand and resist any relative vertical movement. Upon loosening of the bolts 78, the slots 42 permit limited transverse movement of the subframe relative to the stand to enable the web to be adjusted relative to the axis 24.

The material 22 is moved through the feeder 20 by one of a pair of carriage assemblies generally designated 80. The carriage assemblies 80 are allochiral and therefore only one will be described in detail. Each carriage assembly 80 is mounted upon a base plate 82 that is supported on opposite ends on the upper surface 62 of the rails 44. A pair of fingers 84 are mounted on the undersurface of each of the base plates 82 to co-operate with a respective one of the rabbets 68 and guide the base plate 82 for movement relative to the rail 44 in a direction transverse to the axis 24. The base plate 82 is locked in position relative to the rail 44 by means of a clamp 86 which is located in a recess formed in the finger 84. The clamp 86 comprises an L shaped lever 88, one end of which bears against the undersurface of the base plate 82 and the other of which passes through the recess to be received in the rabbet 68. A locking screw 90 having an enlarged head 92 passes through a slot formed in the lever 88 and engages a threaded bore 94 in the base plate 82. To lock the base plate to the rail it is simply necessary to tighten the locking screw 90 so that the head bears against the lever 88 and forces the undersurface of the base plate into engagement with the upper surface 62 of the rail 44.

Lateral adjustment of the base plates 82 is provided by the lead screws 56–58 that are rotatably supported on a bearing bracket 96 secured to the side face of the base plate 82. The bracket 96 includes a bore 98 that houses a bearing 100 to accommodate rotation of the lead screw relative to the bracket 96. The lead screw is received in a respective one of the bosses 50–52 on the beam 48 so that rotation of the lead screw by means of a handle 102 provided adjacent the bracket 66 induces a lateral displacement of the base plate 82 relative to the rail 44.

Figure 1:
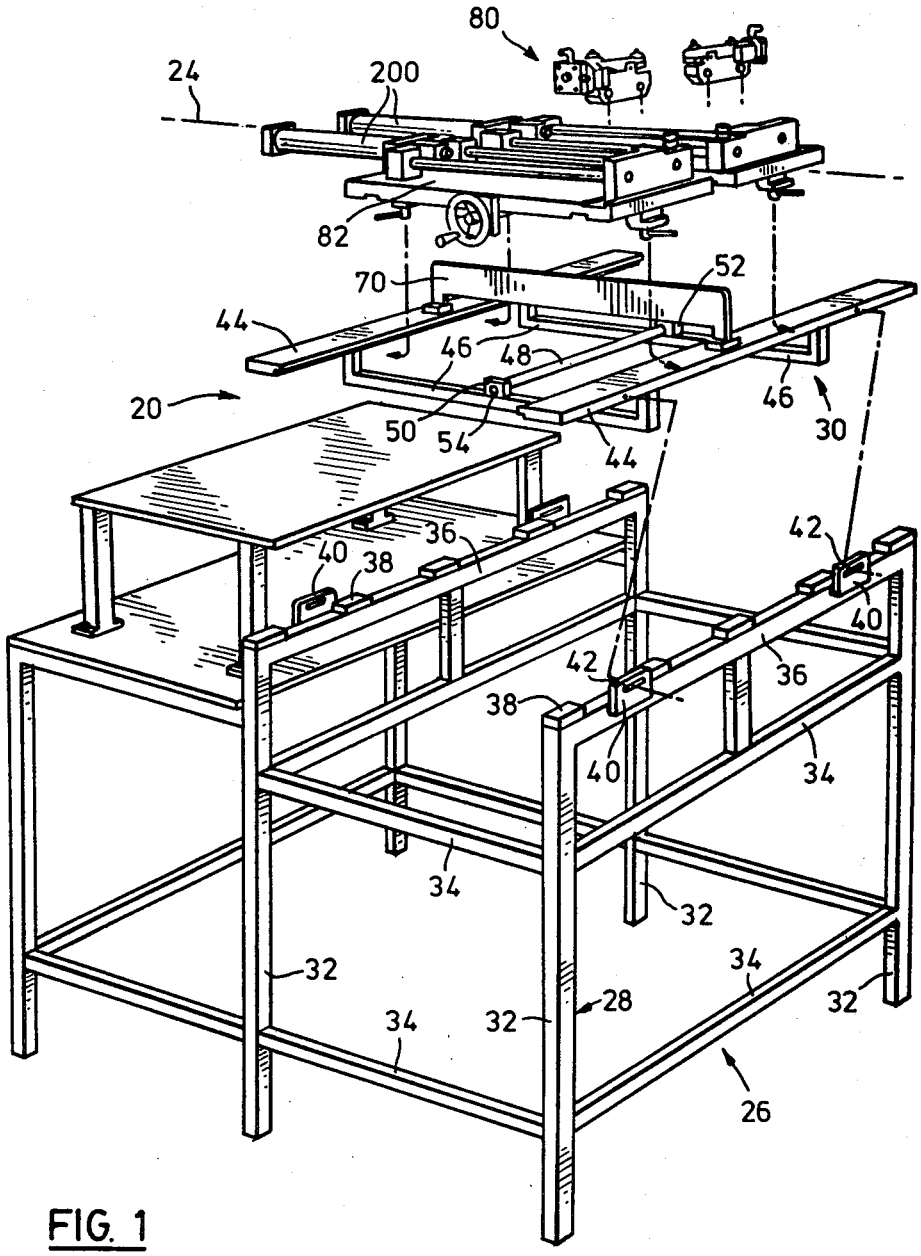
FIG. 1 is an exploded perspective view of a feeder for strip material.
Figure 2:
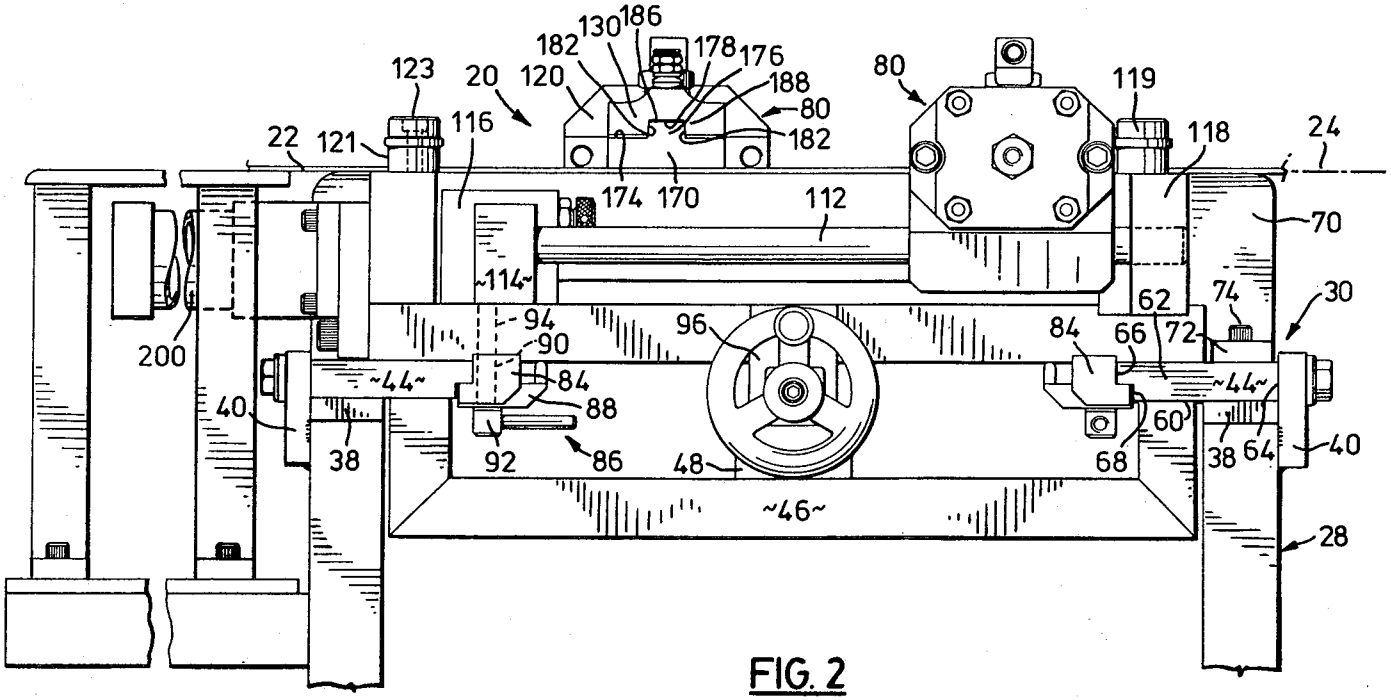
FIG. 2 is a side elevation of the assembled feeder shown in FIG. 1.
Figure 3:
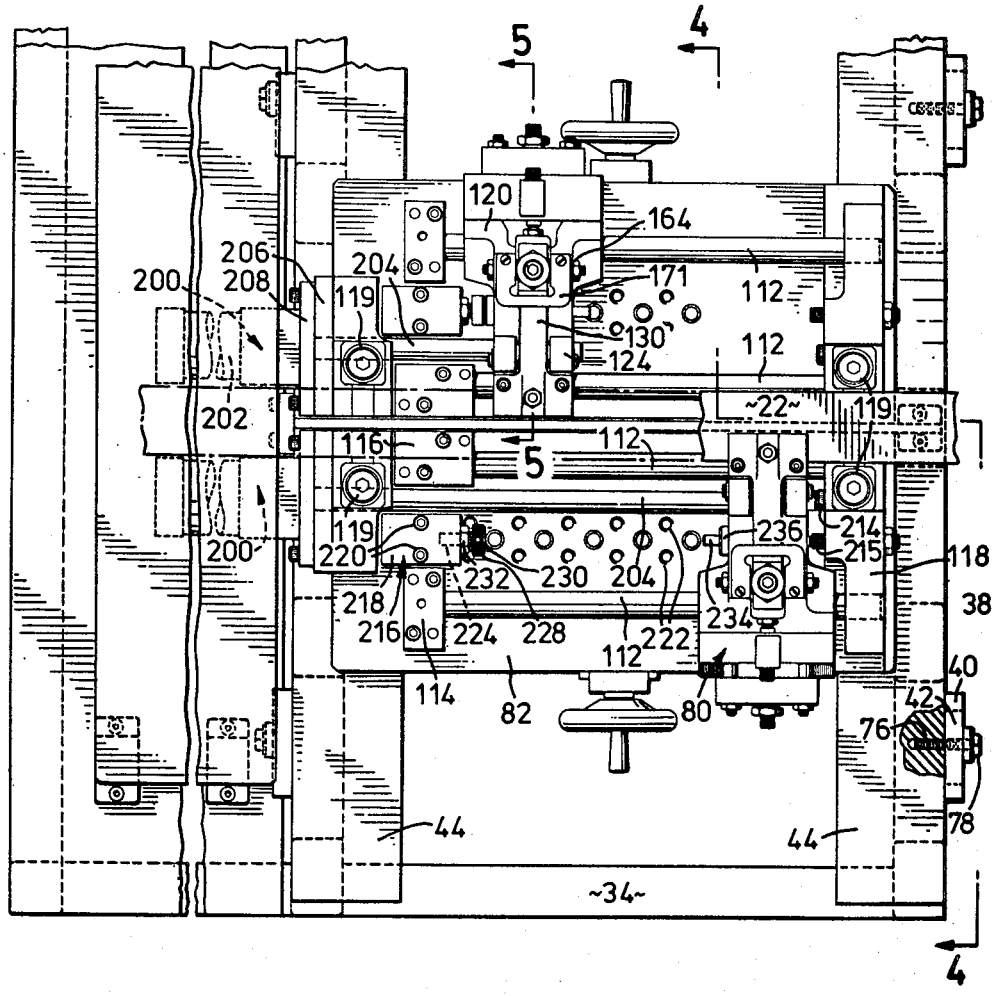
FIG. 3 is a plan view of the feeder shown in FIG. 2.
Figure 4:
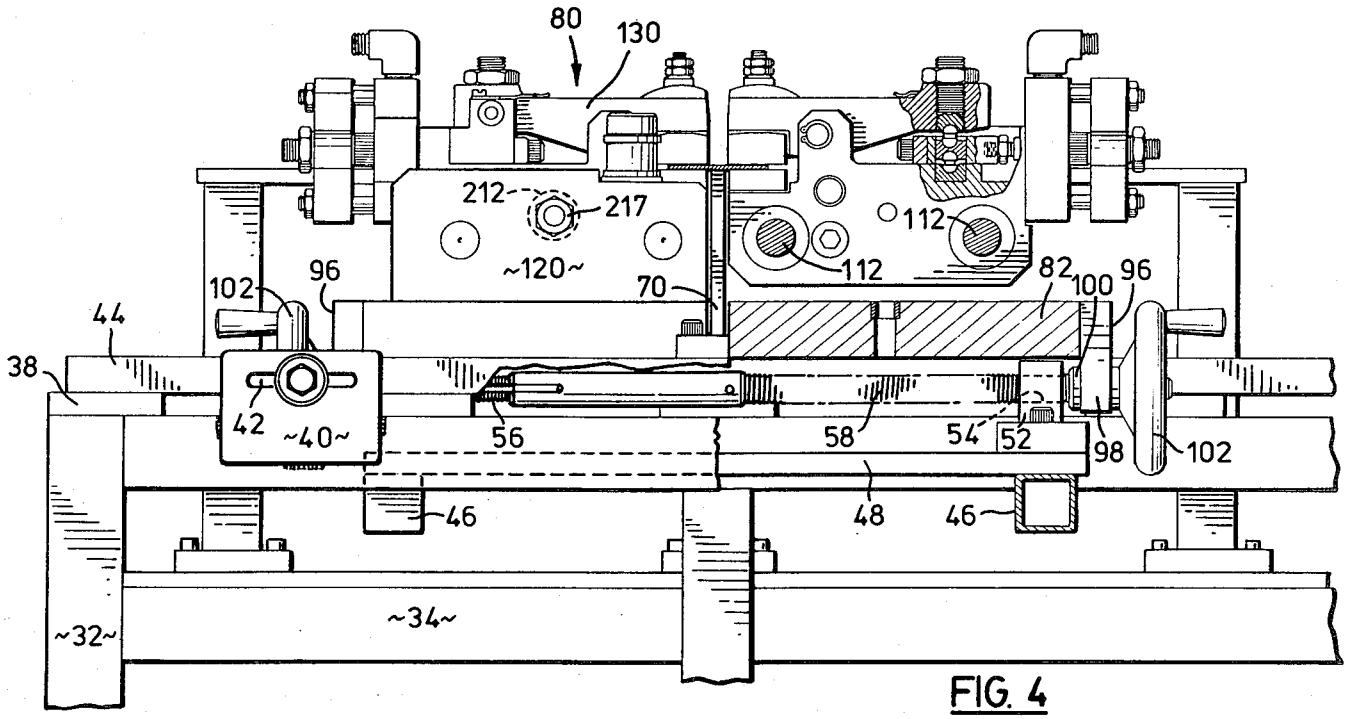
FIG. 4 is a section on the line 4—4 of FIG. 3 showing one half of the feeder in section.
Figure 7:
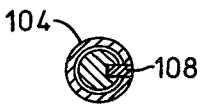
FIG. 7 is a view on the line 7—7 of FIG. 6.
Figure 6:
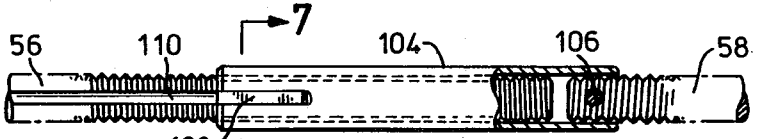
FIG. 6 is a portion of a section of the strip feeder showing the interconnection of a pair of lead screws.

To provide for equal and opposite displacement of the base plates 82 on opposite sides of the web 70 the lead screws 56–58 are interconnected in the manner shown in FIGS. 6 and 7. A sleeve 104 is connected to the lead screw 58 by means of a dowel 106. A key 108 is fixed to the sleeve 104 and projects radially inwardly into engagement with a key way 110 formed in the lead screw 56. The dowel 106, sleeve 104 and key 108 transmit torque between the lead screws 56–58 whilst the key way 110 permits relative movement between the two lead screws in a direction transverse to the axis 24. Thus rotation of one of the lead screws 56–58 will induce equal rotation of the other of the lead screws and thereby displace its respective base plate 82 by equal but opposite amounts. In this way spacing between the carriage assemblies 80 may be varied to accommodate different widths of material 22 and increase the versatility of the feeder 20.

Each of the carriage assemblies 80 includes a pair of rods 112 extending parallel to the axis 24 and the upper surface of the base plate 82. Each of the rods 112 is supported at one end in respective mounting blocks 114–116 and at the other end in a common mounting block 118. The blocks 114, 116 and 118 are securely fastened to the upper surface of the base plate 82 to maintain the rods 112 in parallel spaced relationship. Each of the blocks 116, 118 carries a roller assembly 119 on its upper surface. The roller assembly 119 includes a roller 121 rotatably carried on a vertical screw 123 that passes through the roller and engages a nut slidable in a transverse slot (not shown). The roller assemblies guide the edge of the material 22 as it passes through the feeder 20 and moves with the carriage assemblies as they are adjusted for width. Fine adjustment may be obtained by loosening the screws 123 and moving the roller assembly 119 transversely.

A clamp body 120 has a pair of parallel bores 122 that receive the rods 112 so that the body is mounted for sliding movement relative to the base plate 82 on the rods 112. The body 120 is generally rectangular in cross section and has a pair of ears 124 extending upwardly from the upper surface of the body 120. The upper surface of the body 120 is also recessed adjacent the web 70 to receive a jaw member 126. The jaw member 126 is securely attached to the body 120 and has an upper planar surface 128 that lies in the same plane as the upper surface of the web 70.

A clamping arm 130 has a bore 134 intermediate its ends and is located between the ears 124 to be pivotally secured to the body 120 by means of a pin 132. The pin is secured to the ears and is received in a bushing carried by the arm 130 in the bore 134. A Belleville washer 136 is positioned on the pin 132 between one of the ears 124 and the arm 130 to eliminate play between the arm and the body 120. Relative pivotal movement between the clamp arm and the body 120 is controlled by an air motor 138 having a cylinder 140 connected to the body 120 and a piston rod 142 connected to a linkage 144 extending between the clamp arm and the body 120. The linkage 144 comprises a floating link 146 having a pair of hemispherical recesses 148 on opposite ends of the link 146. A pair of dumb bell shaped links 150–152 extend from the floating link to the body 120 and clamping arm 130 respectively. Each of the dumb bell links 150–152 has a hemispherical formation 154 at each end so that one end of each of the dumb bell links 150–152 is universally connected to the floating link 146 at the hemispherical recess 148. The other end of the dumb bell link 150 is received in a hemispherical recess 156 formed in a bearing pad 158 fixed on the body 120. Similarly, the other end of the dumb bell link 152 is received in a hemispherical recess 160 formed at one end of a stud 162. The stud 162 is threaded into a bore 164 in the arm 130 and is locked in place by means of a lock nut 166. Rotation of the stud 162 in the bore 164 adjusts the relative disposition between the clamp arm 130 and the body 120.

The floating link 146 is connected to the piston rod 142 through a collar 168 that is connected to the piston rod and slides on the upper surface of the body 120. The collar 168 encompasses the floating link 146 so that movement of the piston rod towards or away from the horizontal axis 24 causes a corresponding translation in the floating link 146 and subsequent adjustment of the orientation of the dumb bell links 150–152 relative to the floating link 146.

Movement of the floating link 146 is limited by a stop 167 that extends between two ears 169 formed on the body 120 adjacent the linkage 146. The ears 169 also carry a pair of lock screws that are adjusted to provide a small clearance between the ends of the screws and the arm 130 to resist twisting movement about a vertical axis. The ears also carry a plate spring 171 that extends between the ears and bears against the upper surface of arm 130. The spring 171 acts as a return spring to resist pivotal movement of the arm 130 about the pin 132.

A jaw member 170 is carried by the clamping arm at the opposite end to the linkage 144. The jaw member 170 has a lower surface 172 facing the upper surface 128 of jaw member 26 and has an upper surface 174 in engagement with the underside of the clamp arm 130. A part cylindrical protrusion 176 is formed on the upper surface 174 and is defined by a surface 178 having a constant radius of curvature that is centered at the point 180. The surface 178 is delimited by a pair of end surfaces 182 that are inclined to the upper surface 174 of the jaw member 170. The protrusion 176 is received in a correspondingly shaped recess 184 formed on the underside of the clamp arm 130. The recess 184 is defined by a part cylindrical surface 186 having a centre of curvature located at the point 180 and by a pair of inclined surfaces 188.

The jaw member 170 is secured to the clamp arm 130 by means of a stud 190 that passes through a slot 192 formed in the clamp arm and extends from the surface 186 to a curved surface 194 formed on the upper surface of clamp arm 130. The surface 194 is also of constant radius and has a centre of curvature located at the point 180 so that the generatrices of the surfaces 194, 186 and 178 are co-axial. A washer 196 is interposed between the nuts 198 on the stud 190 and the surface 194 to hold the surfaces 178, 186 in abutment whilst allowing movement of the stud 190 in the slot 192. A Belleville washer 193 is interposed between the washer 196 and nuts 194 to provide a resilient force pulling the jaw member 170 into engagement with the clamping arm 130. The arrangement of the protusion 176, recess 184 and curved surface 194 permits the jaw member 170 to tilt relative to the clamp arm 130 so that the lower surface 178 of jaw member 170 remains parallel with the upper surface 128 of jaw member 26. This tilting, however does not require the adjustment of the stud 190 and the retaining nuts 198 as the curved surfaces are located about the common point 180 and therefore the length of stud 190 required to hold the surfaces 178 and 186 in abutment remains constant. The inclined end surfaces 182 and 188 also function to eliminate play between the clamping arm 130 and the jaw member 170. The surfaces define a wedge so that as the nuts 194 are tightened on the stud 190 the jaw member 170 moves towards the clamping arm 130 until the inclined surfaces are in abutment and have eliminated the end play.

Movement of the carriage assembly 80 along the rods 112 is controlled by an extensible motor 200 mounted on the base plate 82 and which comprises a cylinder 202 and a piston rod 204. A flange 208 mounts the cylinder 202 on a block 206 which is itself secured to the base plate 82 by cap screws 210. The piston rod 204 is located in a blind bore 212 in the body and is secured by means of a bolt 217.

The motors 200 are double acting and supplied with air from a source that is not shown. The supply of air to either the head or rod side of the motor 200 is controlled by conventional solonoid operated valves which are not shown as they are of a conventional nature. It will be apparent that extension and retraction of the motor 200 causes a corresponding reciprocating movement of the carriage assembly 80 along the rods 112. Movement of the carriage assembly is limited by a pair of stops 214–216 one of which, 214 is mounted on the mounting block 118. The other stop 216 comprises a block 218 secured to the base plate 82 by means of a pair of screws 220. The screws 220 are received in holes 222 formed in the base plate 22 and arranged in pairs at spaced intervals along the length of the base plate 82. The block 218 has a threaded bore 224 in the face facing the carriage assembly 80 to receive a threaded screw 226 whose position is fixed by means of a lock nut 232. The screw 226 has an enlarged knurled head 228 that presents a planar surface 230 towards the carriage assembly 80. This configuration of the stop 216 permits a course adjustment of the travel of the carriage 82 by moving the block to a new pair of holes 222 and permits fine adjustment by rotating the screw 226 in its bore 224 to vary the position of the planar surface 230.

The stop 214 is abutted by a piston rod 234 of a dash pot 236 carried by the body 120 of the carriage assembly 80. The piston rod 234 extends to either side of the body 120 and abuts an adjustable screw 215 carried the mounting block 114 at one end of its travel so that movement of the carriage assembly 80 is decelerated at either end.

The set up and operation of the feeder will now be described assuming it is to feed material 22 intermittently along the axis 24 from a roll of material to a press. The stand 28 is positioned so that the web 70 is approximately aligned with the axis 24 upon which the material is to be fed. The exact position of the axis 24 will of course depend on the position of the press and the nature of the material being fed but will generally be located on the centre line of both the material and press. The exact position of the web 70 is adjusted by moving the sub-frame 20 relative to the stand 28 after releasing the bolts passing through the slots 42 in plate 40. Once the sub-frame is accurately aligned with the press, the bolts are retightened and the sub-frame and stand form an integral unit.

The clamp 86 is released to permit adjustment of the base plates 82 relative to the sub-frame 30. This adjustment will depend primarily upon the width of the material 22 being fed and this adjustment is effected by means of the lead screws 56–58. The handle 102 is rotated in an appropriate direction to rotate the lead screws 56–58 and cause transverse movement of the base plates 82 along the rails 44. The base plates 82 are positioned so that the carriage assemblies are as close as possible to the web 70 whilst permitting the free movement of material between the two assemblies. If necessary the guide roller assemblies 119 are adjusted to provide free movement of the material Once the position of the base plates 82 has been adjusted, the clamp 86 is tightened to firmly hold the base plates 82 relative to the rails 44. The travel of each carriage assembly along the rods 112 is then adjusted to correspond to the amount of material to be fed to the press during each stroke of the feeder 20. This adjustment is made by releasing the screws 226 securing the block 218 of stop 116 and relocating the block at an appropriate position along the base plate 82. Fine adjustment of the stroke is achieved by rotation of the screw 226 until the surface 230 is at the required position to limit movement of the carriage assembly.

The final adjustment is to adjust the spacing between the surface 128 of jaw member 126 and the lower surface 172 of jaw member 170. This is achieved by rotation of the stud 162 in the bore 164 after the lock washer 166 has been released. The stud 162 is adjusted so that the two opposed surfaces of the jaw members tightly grip the material 22 when the dumb bell links 150–152 lie on a common axis. In this position the jaw members 170–172 are at their closest position and the linkage 144 provides a maximum transfer of the claimping forces to the body with a minimum transfer to the piston rod 142. The position of the collar 168 on the piston rod 142 is adjusted so that the dumb bell links 150–152 are aligned just prior to the motor 138 reaching its maximum extension. Retraction of the motor 138 will cause the floating link 146 to move away from the web 70 and move the dumb bell links 150–152 out of alignment. This allows the jaws to move apart under the influence of the return spring 171 and release the material 22.

With the feeder adjustments completed the air control to the motors 138–200 is controlled so that they operate in sequence. The sequence is chosen so that one of the motors 200 advances its carriage assembly 80 whilst the other motor 200 retracts the carriage assembly. The motors 138 are controlled within this sequence so that the jaw members 126–170 are brought into gripping engagement with material prior to the motor 200 advancing the carriage and release the material after the motor 200 has reached the limit of its stroke. The material is advanced intermittently by alternate carriages with the recovery of one carriage to a position in which the material can be advanced occuring during the advancing stroke of the other carriage. In this way the cycle time of the feeder may be reduced and the through-put of the press increased.

The above described feeder provides a number of advantages over previously available feeders. Firstly the ability to adjust the feeder for different widths of material increases the versatility of the feeder and allows different stock material to be used with the same apparatus. The mounting of the carriage assemblies on their individual base plates which may be moved relative to the frame enables this width adjustment to be made without undue dismantling of the apparatus.

Further, the stroke of the motor 138 is minimized and the forces acting on the clamping arm are transfered to the body 102 rather than to the piston rod of the motor 138. This enables the life of the motor to be increased as the bearing assembly of the piston rod in the cylinder is not subjected to excessive transverse loads. This also enables the accuracy of the clamping arrangement to be maintained and eliminates play due to wear in the motor.

An alternative form of clamping arrangement is shown in FIG. 8 in which the floating link 146 and dumb bell links 150–152 are replaced by a wedge member 250. A roller 252 is rotatably mounted at the end of the clamp arm 130A to roll along the incline surface of the wedge 250. Once again this arrangement enables the clamping forces to be transferred to the body 120 rather than in to the piston rod of the motor 138A but does require a slightly longer stroke from the motor 138A.

It will be apparent that the feeder 20 may also be used to continuously feed material rather than intermittently feed the material. With such an arrangement it is necessary that the motors 200 be sequenced so that the motor in the fully retracted position starts to extend just prior to the motor in the fully extended position reaching the end of its stroke. To avoid mismatch between the speeds of the material, the jaw members 170 are modified slightly to allow slip of the material through the jaws in the direction of feed. Such an arrangement is shown in FIG. 9 in which a clamping arm 130B replaces the clamping arm 130 shown in the previous figures. The clamping arm 130B has a recess 260 formed in the face facing the web 70 and receives a jaw 262 that is mounted on a screw 264. The jaw 262 has a clamping surface 266 that is eccentric to the axis of the screw 264. The jaw 262 rotates about the screw 264 by virtue of the frictional engagement of the surface 266 with the material 22B and when moving in the direction of feed brings the surface 266 to bear against the material. However, upon the material being moved at a speed greater than the clamping arm 130B the jaw member 264 will rotate in the opposite direction to relieve the surface 266. This allows a slight overlap between the strokes of the motor 200 and ensure continuous feeding of the material.

The embodiments of the invention in which an exclusive property or privilege is claimed are defined as follows:

1. A feeder for feeding strip material along an axis, said feeder comprising a frame, a pair of carriage assemblies disposed on opposite sides of said axis and each including a carriage to reciprocate parallel to said axis to move material therealong, mounting means to mount said carriage assemblies on said frame and including guide means to permit sliding movement of at least one of said carriages relative to said frame in a direction transverse to said axis and adjustment means to adjust the disposition of said one carriage assembly relative to said axis whereby the spacing between said carriages may be varied to accommodate different widths of material.

2. A feeder according to claim 1 wherein said mounting means includes a pair of base plates each to support a respective carriage assembly on said frame.

3. A feeder according to claim 2 wherein said adjustment means acts between at least one of said base plates and said frame.

4. A feeder according to claim 3 wherein said adjustment means includes a lead screw acting between said frame and said one base plate whereby rotation of said lead screw induces displacement of said one base plate relative to said frame.

5. A feeder according to claim 4 wherein each of said base plates is moveable relative to said frame and a leadscrew extends between each base plate and said frame.

6. A feeder according to claim 5 wherein said leadscrews are interconnected so that rotation of one leadscrew causes equal and opposite adjustment of both base plates.

7. A feeder according to claim 6 wherein each leadscrew is rotatably mounted on a respective base plate and engages in a threaded boss mounted on said frame, said lead screws being interconnected by a torque transmitting sleeve to permit relative movement between said lead screws in a direction transverse to said axis.

8. A feeder according to claim 2 wherein said frame includes a pair of rails and said guide means act between said rails and said base plates.

9. A feeder according to claim 2 wherein said frame comprises a stand and a subframe supported on said stand, said subframe supporting said base plates and being moveable relative to said stand in a direction transverse to said axis to adjust the position of said carriage assemblies.

10. A feeder according to claim 9 wherein said subframe comprises a pair of rails extending transverse to said axis of spaced locations and interconnected by a structural member, said base plates being supported on said rails with said guide means acting therebetween.

11. A feeder having a carriage mounted for reciprocal movement along an axis to move material along the axis, and a clamp moveable with said carriage and comprising a pair of clamp members each having a jaw mounted thereon and being moveable relative to one another to move said jaws into gripping engagement with said material, an actuator acting between said clamping members to transmit forces directly therebetween and motor means operable on said actuator to cause displacement of said actuator and induce relative movement between said clamping members, whereby forces generated by said jaws gripping said material are transmitted between said clamping members through said actuator to minimise forces acting on said motor means.

12. A feeder according to claim 11 wherein said clamping arms are pivotally connected to one another for relative movement about a pivot axis.

13. A feeder according to claim 12 wherein said pivot connection of said clamping members is located between said jaws and said actuator.

14. A feeder according to claim 13 wherein said motor means causes displacement of said actuator in a direction normal to the pivot axis of said clamp members.

15. A feeder according to claim 14 wherein said actuator comprises a linkage extending between said clamping members and having a plurality of links, one of which is displacable by said motor means to cause pivotal movement between said clamp members.

16. A feeder according to claim 15 wherein said linkage comprises a pair of anchored links connected by respective ones of said clamping arms and an intermediate link connecting said anchored links, said intermediate link being displacable relative by said motor means to cause pivotal movement of said clamp members.

17. A feeder according to claim 16 wherein said linkage extends along an axis perpendicular to said pivot axis and the direction of displacement of said actuator.

18. A feeder according to claim 13 wherein one of said jaws is mounted on its respective clamping arm to permit limited tilting movement relative thereto to accommodate different material thicknesses.

19. A feeder according to claim 1 including a clamp mounted on each of said carriages, each clamp comprising a pair of clamp members each having a jaw mounted thereon and being moveable relative to one another to move said jaws into gripping engagement with said material, an actuator acting between said clamping members to transmit forces directly therebetween and motor means operable on said actuator to cause displacement of said actuator and induce relative movement between said clamping members, whereby forces generated by said jaws gripping said material are transmitted between said clamping members through said actuator to minimise forces acting on said motor means.

20. A feeder according to claim 19 wherein said clamping arms are pivotally connected to one another for relative movement about a pivot axis.

21. A feeder according to claim 20 wherein said pivot connection of said clamping members is located between said jaws and said actuator.

22. A feeder according to claim 21 wherein said motor means causes displacement of said actuator in a direction normal to the pivot axis of clamp members.

23. A feeder according to claim 22 wherein said actuator comprises a linkage extending between said clamping members and having a plurality of links, one of which is displaceable by said motor means to cause pivotal movement between said clamp members.

24. A feeder according to claim 23 wherein said linkage comprises a pair of anchored links connected by respective ones of said clamping arms and an intermediate link connecting said anchored links, said intermediate link being displaceable relative by said motor means to cause pivotal movement of said clamp members.

25. A feeder according to claim 24 wherein said linkage extends along an axis perpendicular to said pivot axis and the direction of displacement of said actuator.

26. A feeder according to 21 wherein one of said jaws is mounted on its respective clamping arm to permit limited tilting movement relative thereto to accommodate different material thicknesses.

* * * * *